US008851403B2

(12) United States Patent
Thomas et al.

(10) Patent No.: US 8,851,403 B2
(45) Date of Patent: Oct. 7, 2014

(54) MULTIPLE DISCHARGE AIR INDUCTION SPRAY NOZZLE ASSEMBLY

(75) Inventors: Lawrence Eric Thomas, West Chicago, IL (US); Jahir Leonardo Caro, Chicago, IL (US)

(73) Assignee: Spraying Systems Co., Wheaton, IL (US)

( * ) Notice: Subject to any disclaimer, the term of this patent is extended or adjusted under 35 U.S.C. 154(b) by 71 days.

(21) Appl. No.: 13/211,518

(22) Filed: Aug. 17, 2011

(65) Prior Publication Data

US 2013/0043321 A1 Feb. 21, 2013

(51) Int. Cl.

| | |
|---|---|
| ***B05B 1/26*** | (2006.01) |
| ***E03C 1/08*** | (2006.01) |
| ***B05B 1/14*** | (2006.01) |
| ***B05B 1/20*** | (2006.01) |

(52) U.S. Cl.

USPC ..... 239/523; 239/520; 239/521; 239/522; 239/428.5; 239/561; 239/159

(58) Field of Classification Search

CPC ..... B05B 15/069; B05B 1/267

USPC ..... 239/518–523, 159–165, 428.5, 548, 239/391, 394, 396, 560, 561, DIG. 1, 726, 239/743, 500, 502, 77, 419.5

See application file for complete search history.

(56) References Cited

U.S. PATENT DOCUMENTS

| | | | | | |
|---|---|---|---|---|---|
| 2,856,236 | A | * | 10/1958 | Hunziker | 239/515 |
| 3,149,784 | A | * | 9/1964 | Skidgel | 239/206 |
| 3,189,283 | A | * | 6/1965 | Moore | 239/222.17 |
| 4,353,508 | A | * | 10/1982 | Butterfield et al. | 239/590.3 |
| 4,461,426 | A | * | 7/1984 | Christopher | 239/394 |
| 4,815,665 | A | * | 3/1989 | Haruch | 239/432 |
| 4,828,182 | A | * | 5/1989 | Haruch | 239/432 |
| 5,190,222 | A | * | 3/1993 | Haruch | 239/523 |
| 5,240,184 | A | * | 8/1993 | Lawson | 239/499 |
| 5,275,340 | A | * | 1/1994 | Haruch | 239/523 |
| 5,333,794 | A | * | 8/1994 | Haruch | 239/600 |
| 5,871,156 | A | * | 2/1999 | Lawson | 239/201 |
| 6,161,778 | A | * | 12/2000 | Haruch | 239/290 |

(Continued)

OTHER PUBLICATIONS

U.S. Patent & Trademark Office, International Search Report in International Patent Application No. PCT/US2012/050372 (Oct. 11, 2012).

(Continued)

*Primary Examiner* — Len Tran
*Assistant Examiner* — Alexander M Valvis
(74) *Attorney, Agent, or Firm* — Leydig, Voit & Mayer, Ltd

(57) ABSTRACT

A liquid spraying system comprising a plurality of spray nozzles mounted in dependent fashion a liquid supply boom that travels in a field in a direction of movement. The liquid spray nozzle each have a first liquid discharge orifice and deflector flange for directing discharging liquid at a first angle to the vertical in a leading direction, and a second discharge orifice and deflector flange for simultaneously directing liquid in a trailing direction from a different elevation and at a second angle to the vertical different from the first angle for complete coverage of plant foliage.

15 Claims, 3 Drawing Sheets

(56) References Cited

U.S. PATENT DOCUMENTS

| | | | | |
|---|---|---|---|---|
| 6,422,483 | B1 * | 7/2002 | Yocom et al. | 239/159 |
| 7,303,153 | B2 * | 12/2007 | Han et al. | 239/461 |
| 7,311,004 | B2 * | 12/2007 | Giles | 73/592 |
| 7,380,732 | B2 * | 6/2008 | Bolman et al. | 239/568 |
| 7,472,843 | B2 * | 1/2009 | Pearson et al. | 239/428.5 |
| 7,861,946 | B2 | 1/2011 | Beeren | |
| 8,113,443 | B2 * | 2/2012 | Zur | 239/240 |
| 8,177,148 | B1 * | 5/2012 | Renquist et al. | 239/587.1 |
| 2004/0262432 | A1 * | 12/2004 | Norman | 239/556 |

OTHER PUBLICATIONS

U.S. Patent & Trademark Office, Written Opinion of the International Search Authority in International Patent Application No. PCT/US2012/050372 (Oct. 11, 2012).

* cited by examiner

FIG. 3
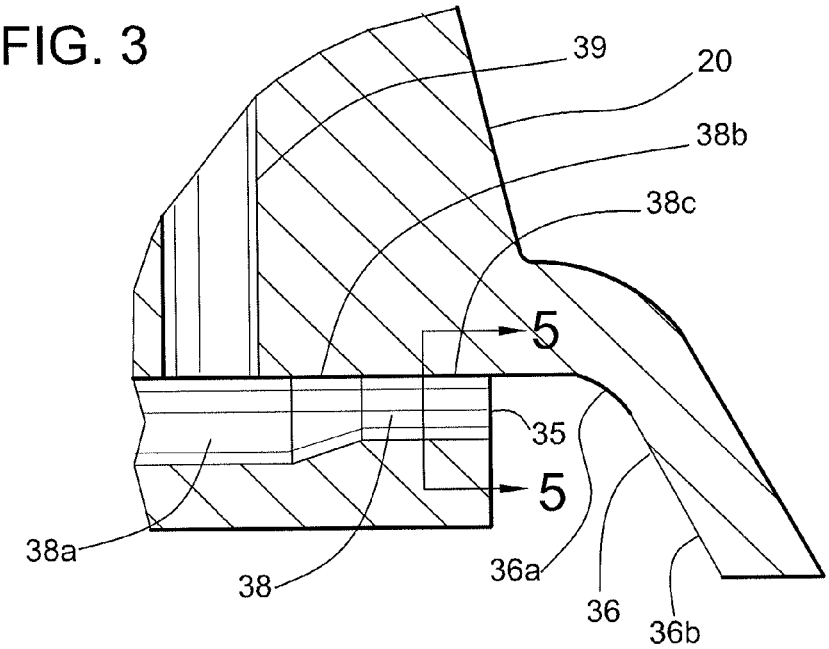
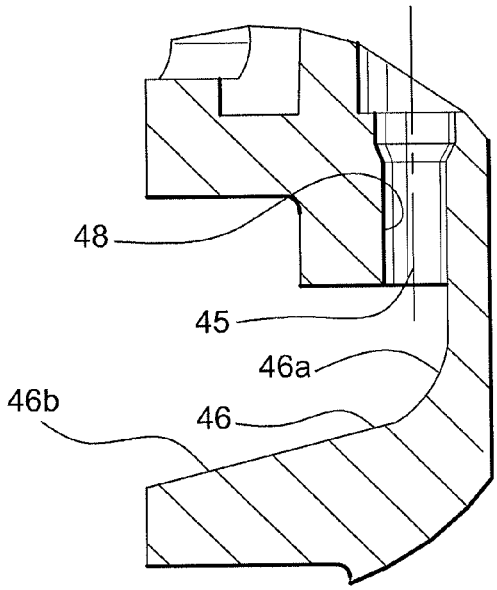
FIG. 4
FIG. 5
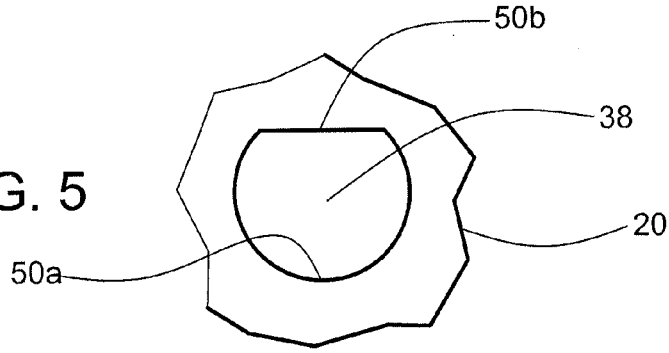

MULTIPLE DISCHARGE AIR INDUCTION SPRAY NOZZLE ASSEMBLY

FIELD OF THE INVENTION

The present invention relates generally to spray nozzle assemblies, and more particularly, to spray nozzle assemblies particularly adapted for spraying agricultural chemicals.

BACKGROUND OF THE INVENTION

Agricultural sprayers typically have a spray boom with a plurality of spray nozzles which are adapted for spraying liquid chemicals from overhead the plants. In wheat crops, for example, at a certain stage in growth toward maturity, the plants are susceptible to a fungus. While there are fungicides effective for combating and preventing such fungi, the coverage of the plant must be very complete. Because the heads of wheat plants are so vertically oriented, it is difficult to completely cover the plant head by overhead spraying typical of conventional agricultural sprayers. It also can be difficult to effectively cover the wheat plant heads without excessive and costly chemical wastage.

OBJECTS AND SUMMARY OF THE INVENTION

It is an object of the present invention to provide a spray nozzle assembly adapted for spraying agricultural chemicals onto difficult to spray crops with more complete coverage.

Another object is to provide a spray nozzle assembly as characterized above which is adapted for directing sprays from different locations and angles onto crops during a single passage of the sprayer for a more effective chemical coverage of the plant.

A further object is to provide a spray nozzle assembly of the foregoing type which more efficiently effects complete plant spray coverage with less chemical waste.

Still another object is to provide a spray nozzle assembly of the above kind that is relatively simple in construction and lends itself to economical manufacture.

Another object is to provide an improved method of spraying fungicides onto wheat crops.

Other objects and advantages of the invention will become apparent upon reading the following detailed description and upon reference to the drawings, in which:

BRIEF DESCRIPTION OF THE DRAWINGS

FIGS. 3 and 4 are enlarged fragmentary sections of the outer nozzle body taken in the planes of 3 and 4 of FIG. 2; and FIG. 5 is an enlarged fragmentary section of one of the liquid discharge orifices of the illustrated outer nozzle body, taken in the plane of line 5-5 in FIG. 3.

Figure 1:
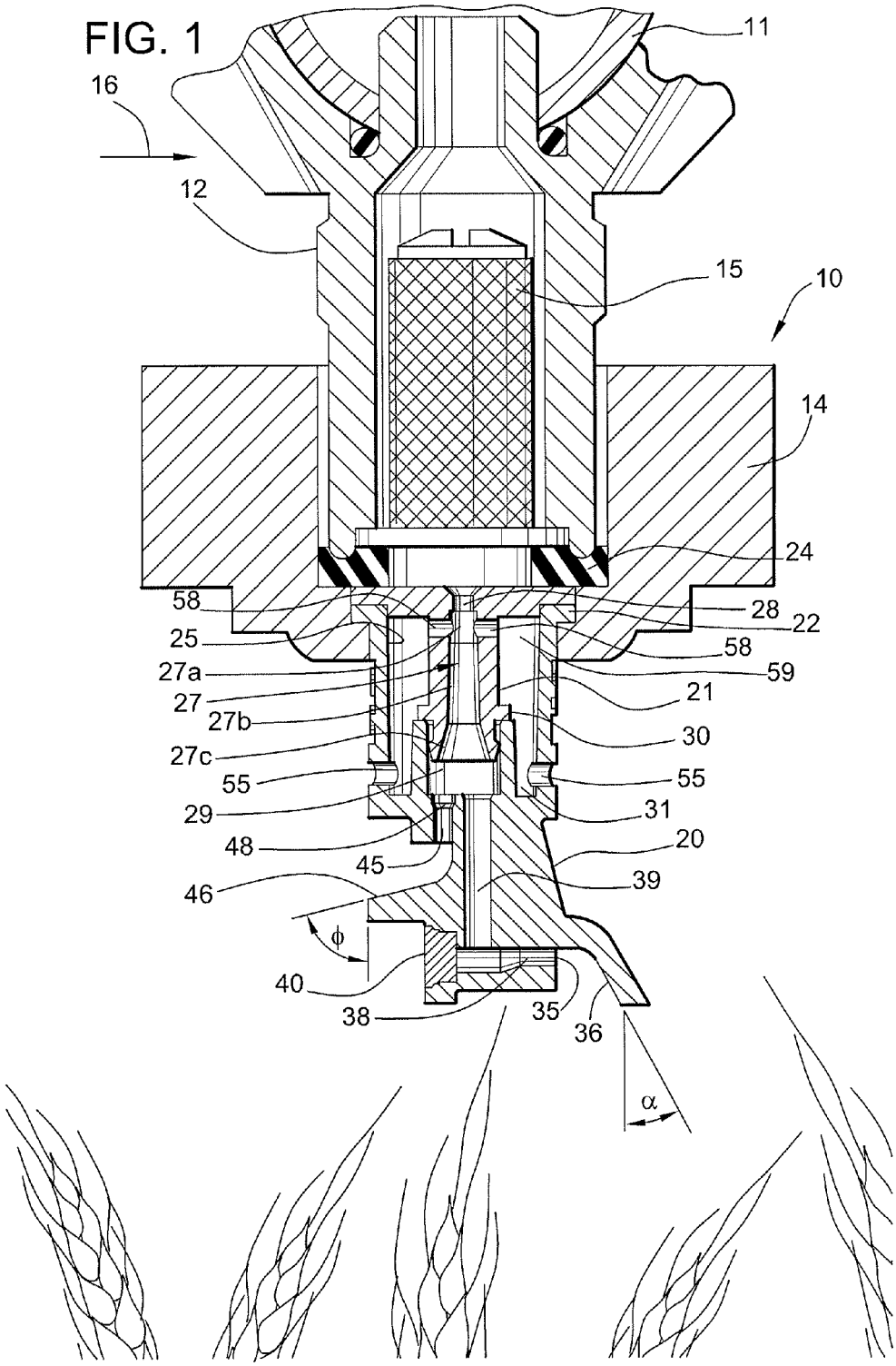
FIG. 1 is a vertical section of an illustrative spray nozzle assembly in accordance with the invention.
Figure 2:
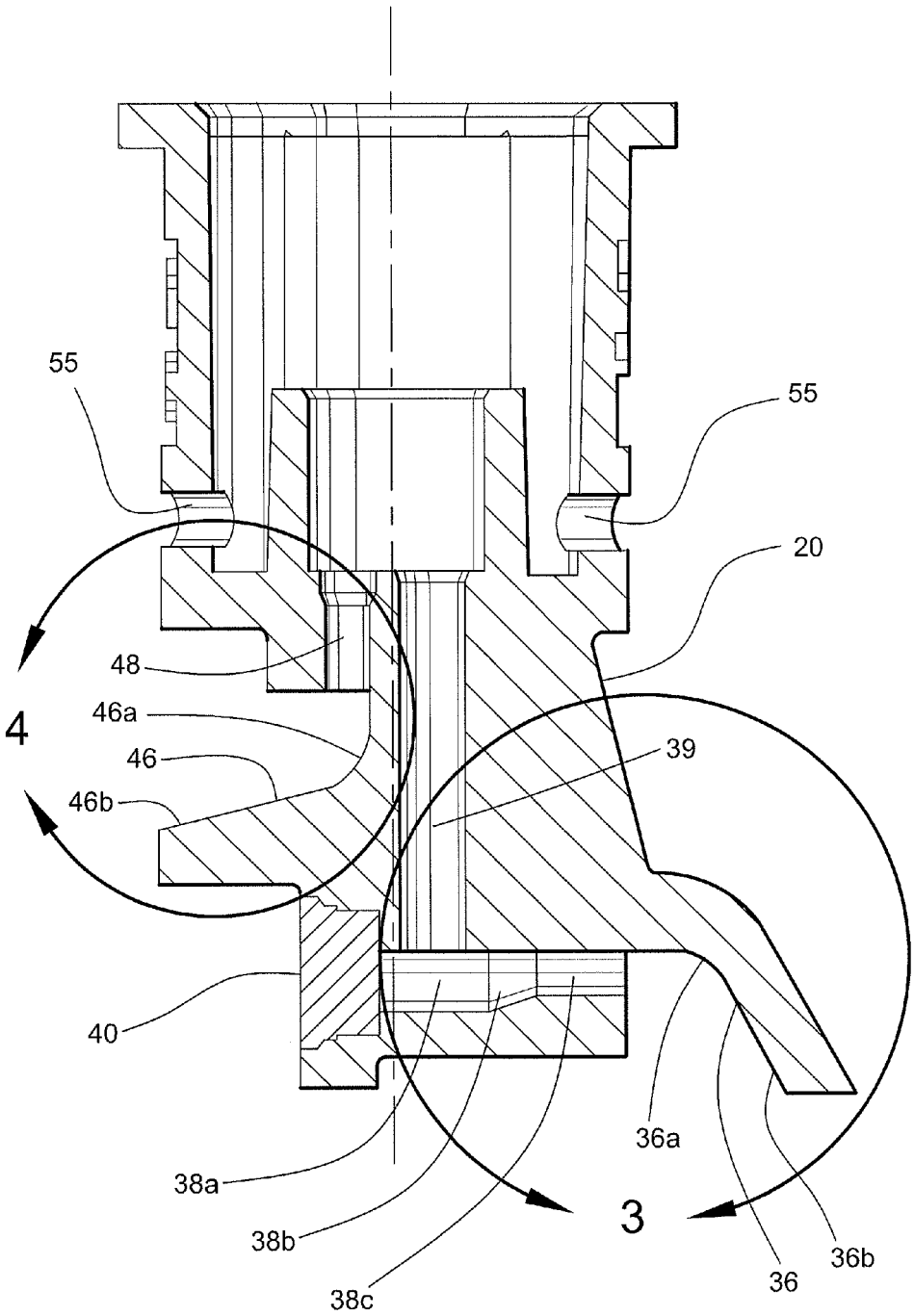
FIG. 2 is an enlarge vertical section of the outer nozzle body of the illustrated spray nozzle assembly.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring now more particularly to the drawings, there is shown an illustrative spray nozzle assembly 10 in accordance with the invention mounted on a liquid supply boom 11, such as the boom of an agricultural sprayer. The boom 11 in this instance has a tubular configuration through which the liquid is directed from a supply tank. Each spray nozzle assembly 10 is mounted on a respective liquid supply stem 12 fixed in depending fluid communication on the boom 11. A cylindrical strainer 15 in this instance is mounted within the stem 12 in a conventional manner. For removably securing the spray nozzle assembly 10 on the stem 12, a retention cap 14 is provided which may be of the type disclosed in Butterfield et al., U.S. Pat. No. 4,527,745, assigned to the same assignee as the present application. It will be understood that a plurality of such spray nozzle assemblies 10 are supported in laterally-spaced relation along the boom 11 for travel through the field in the direction of movement of the boom as indicated by the arrow 16 in FIG. 1.

The illustrated spray nozzle 10 basically has a two-part construction, comprising an outer body 20 and an inner body insert 21. The outer nozzle body 20 is formed with an annular retaining flange 22 which is secured to the liquid inlet stem 12 of the boom 11 with an annular sealing gasket 24 interposed therebetween. The inner body insert 21 in this case has an annular construction that is positionable within a cavity 25 in an upstream end of the outer body 20 and defines a liquid passage 27 communicating with the liquid supply stem 12.

The liquid passage 27 defined by the inner body insert 21 includes a nozzling zone which includes a metering orifice 28 in which the liquid stream is and a downstream expansion chamber including a first cylindrical chamber section 27*a* immediately downstream of the nozzling zone 28, and outwardly flared conical passage sections 27*b*,27*c*, downstream thereof. The inner body insert passage 27 in turn communicates with a cylindrical manifold expansion chamber 29 within the outer body 20. The inner body insert 21 in this instance has an outwardly extending annular flange 30 intermediate its ends and an inwardly tapered downstream end portion 31 which are adapted for press fit scaling engagement within the internal cavity 25 of the outer nozzle body 20.

In accordance with one aspect of the invention, the spray nozzle assembly has a pair of discharge orifices adapted to spray liquids onto agricultural crops from different elevations and positions and at different angles to the central vertical axis of the spray nozzle assembly during a single passage of the spray boom through the field. More particularly, the spray nozzle assembly has a pair of discharge orifices adapted for directing separate leading and trailing spray patterns at different angles onto front and rear sides of the plant foliage during passage of the spray boom through a field. To this end, in the illustrative embodiment, the outer nozzle body 20 has a first or leading liquid spray discharge orifice 35 communicating with the manifold expansion chamber 29 for directing liquid onto a deflector surface 36 oriented at a relatively small angle a, such as about 30°, to the vertical axis of the nozzle assembly 10 in the direction of travel, i.e., leading direction, of the spray boom 11. The illustrated deflector surface 36 includes a curved surface section 36*a* and a flat lip section 36*b* that defines the angle of the spray discharge. The leading discharge orifice 35 in this case is defined by a horizontal passage 38 that communicates with a vertical passage 39, which in turn communicates with the expansion chamber 29. The horizontal passage 38 comprises a first passage section 38*a* that communicates between the vertical passage 39 and an inwardly tapered conical section 38*b* that in turn communicates with a smaller diameter passage section 38*a*. To facilitate injection molding, a plug 40 closes the end of the horizontal passage opposite the discharge orifice 35.

In carrying out the invention, the outer nozzle body 20 has a second liquid spray discharge orifice 45 and deflector surface 46 for directing a liquid spray in a trailing direction relative to movement of the boom and at a different angle to the vertical than the first discharge orifice 35 and deflector 36 for effectively covering an opposite side of plant foliage. The second discharge orifice 45, which in this case also is located at a higher elevation than the first discharge orifice 35, is defined by a vertical passage 48 that communicates between the manifold chamber 29 on a side opposite that of the vertical passage 39 and into tangential relation with the deflector surface 46 which has a curved section 46*a* and a flat lip section 46*b* extending rearwardly in relation to the direction of travel. The lip section 46*b* in this case extends at a substantially greater angle Ø to the vertical axis of the spray nozzle assembly than the deflector surface lip section 36*b*, such as 75°, in the leading direction.

It will be seen that as the spray boom 11 is moved through the field in a direction of travel 16 the discharge spray from the second or trailing discharge orifice 45 will impinge upon an opposite side of the plant foliage and at a different angle relative to the vertical then the spray discharge from the first or leading discharge orifice 35 effecting substantially complete coverage of the foliage, and particularly the vertically extending heads of wheat plants.

In keeping with one embodiment, the passages 38,39 and 48 that communicate between the expansion chamber 29 and which define the leading and trailing discharge orifices 35,45 have effective flow areas such that the leading and trailing sprays have substantially equal liquid distribution. In this case, the passages 38,39 that communicate with and define the first or leading discharge orifice 35 are sized larger than the shorter length passageway 48 that defines the second or trailing discharge orifice 45 such that a substantially equal liquid distribution is discharged from the leading and trailing discharge orifices. The vertical passageway 48 that defines the trailing discharge orifice 45 in this case has a cylindrical configuration that communicates tangentially with the deflector flange surface 46 and horizontal passage 38 defines the leading discharge orifice 35 has a cylindrical side wall 50*a* section with a flat 50*b*, as depicted in FIG. 5, that extends tangentially with the deflector surface 36.

In accordance with a further aspect of the illustrated embodiment, the spray nozzle assembly 10 has venturi air inlets 55 that communicate between ambient air and the nozzling zone of the inner body insert 21, in this case, the passage section 27*a* immediately downstream of the metering orifice 28, such that ambient air is drawn into the liquid flow stream and entrained in the liquid spray particles ultimately generated and discharged from the leading and trailing discharge orifices 35,45. Due to the pressure drop resulting from the liquid passage through the nozzling zone and the entrainment of air in the liquid spray particles, extremely fine liquid particles that otherwise are subject to drift and difficult to direct onto the plant foliage are substantially eliminated from the discharging spray patterns. To this end, in the illustrated embodiment, the nozzle body insert 21 has a plurality of venturi passages 58 communicating transversely with the liquid inlet passage section 27*a* immediately downstream of the metering orifice 28. The venturi passages 58 in this case each communicate with an annular air flow passage 59 disposed in surrounding relation to the nozzle body insert 21, which in turn communicate with ambient air through the plurality of air inlet passages 55 extending radially through the outer nozzle body member 20. The annular air passageway 59 in this instance is defined between the inner perimeter of the outer body member cavity 25 and the outer perimeter of the nozzle body insert 21. It will be seen that as pressurized liquid is directed through the nozzling zone 28 and into the passage section 27*a*, the resulting high velocity flow stream generates a negative pressure at the venturi air passageways 58, drawing ambient air through the annular passage 59 and ambient air inlets 55 for intermixing with the liquid flow stream, which is entrained into the liquid spray particles as they are discharge from the leading and trailing discharge orifices 35,45 for more reliable direction onto the plant foliage without undesirable drifting and chemical waste.

The invention claimed is:

1. A liquid spray system for spraying vegetation comprising:

an elongated liquid supply boom movable for travel in a direction of movement perpendicular to its elongated length, a liquid spray nozzle having a nozzle body with a liquid inlet in fluid communication with said liquid supply boom and a liquid flow passage extending along an axis of said nozzle body, said nozzle body having a first liquid discharge orifice communicating with said liquid flow passage for discharging pressurized liquid from said liquid flow passage and a first deflector flange having a lip portion that projects downwardly and forwardly in relation to said direction of movement at a first angle to the nozzle body axis for directing a first pressurized liquid spray discharging from said first discharge orifice at said first angle to said nozzle body axis in a leading direction relative to movement of said boom, and said nozzle body having a second discharge orifice communicating with said liquid flow passage for discharging a second pressurized liquid spray from said liquid flow passage simultaneously with and separate from said first liquid spray and a second deflector flange surface that projects downwardly and rearwardly in relation to said direction of movement at a second angle to the nozzle body axis different from said first angle, the angle the first deflector flange projects forwardly with respect to the nozzle body axis for directing the second discharging liquid spray from said second discharge orifice in a trailing direction relative to said movement of said boom and at said second angle to said nozzle body axis such that said spray nozzle simultaneously sprays liquid on front and back sides of vegetation during a single passage of said spray boom in the direction of movement.

2. The liquid spray system of claim 1 in which said nozzle body is mounted in depending relation to the liquid supply boom with the said nozzle axis vertically oriented.

3. The liquid spray system of claim 2 in which said first angle is about 30°, and said second angle is about 75°.

4. The liquid spray system of claim 1 in which said first deflector surface includes a curved surface section and a flat lip section oriented at said first angle and extending downstream of said first liquid discharge orifice in the leading direction relative to movement of the liquid supply boom, and said second deflector surface includes a curved section and a flat lip section oriented at said second angle to the nozzle body axis extending downstream of said liquid discharge orifice in trailing direction relative to movement of the liquid supply boom.

5. The liquid spray system of claim 1 in which said liquid flow passage includes a metering orifice for accelerating pressurized liquid directed through said nozzle body and an expansion chamber downstream thereof, and said first and second discharge orifices each are in fluid communication with said expansion chamber.

6. The liquid spray system of claim 5 in which said nozzle body includes an outer body and an inner body insert disposed within said outer body which defines a part of said liquid flow passage including said metering orifice.

7. The liquid spray system of claim 5 in which said first discharge orifice is defined by a horizontally oriented passage, and said horizontally oriented passage communicates with said expansion chamber through a first vertically oriented passage.

8. The liquid spray system of claim 7 in which said second discharge orifice is defined by and communicates with said expansion chamber through a second vertically oriented passage parallel to said first vertically oriented passage.

9. The liquid spray system of claim 5 in which said expansion chamber is defined within said outer nozzle body immediately downstream of said inner body insert.

10. The liquid spray system of claim 2 in which said first discharge orifice is located at a different elevation than said second discharge orifice.

11. The liquid spray system of claim 10 in which said first discharge orifice is located at a lower elevation than said second discharge orifice.

12. The liquid spray system of claim 1 in which said liquid flow passage including a relatively small diameter nozzling zone for accelerating the liquid flow stream directed through said nozzle body and creating a pressure drop therein prior to discharge from said discharge orifice, said nozzle body having an ambient air passage having an inlet in communication with ambient air outside said nozzle, said ambient air passage including a venturi passage communicating with said nozzle zone such that a pressurized liquid flow stream passing through said nozzle zone draws ambient air in said ambient air inlet and venturi passage for mixing with the liquid flow stream prior to discharge from said discharge orifice.

13. The liquid spray system of claim 12 in which said nozzle body includes an expansion chamber in downstream fluid communication with said nozzling zone in which the liquid flow stream passes and expands prior to discharge from said discharge orifice, and said first and second discharge orifices are in fluid communication with said expansion chamber.

14. The liquid spray system of claim 1 in which said liquid supply boom has an elongated hollow configuration through which liquid is directed from said liquid supply, and said liquid supply boom is movable in a direction transverse to an elongated length of the boom.

15. The liquid spray system of claim 14 including a plurality of said spray nozzles supported by liquid supply boom in laterally spaced relation to each other along the elongated length of the liquid supply boom, each said spray nozzle being in fluid communication with the liquid supply boom.

* * * * *